US008978176B1

(12) United States Patent
Oh

(10) Patent No.: US 8,978,176 B1
(45) Date of Patent: Mar. 17, 2015

(54) ADJUSTABLE, COLLAPSIBLE, COMPACT MATTRESS SUPPORT

(71) Applicant: Zinus, Inc., San Leandro, CA (US)

(72) Inventor: Suk Kan Oh, Xiamen (CN)

(73) Assignee: Zinus, Inc., San Leandro, CA (US)

( * ) Notice: Subject to any disclaimer, the term of this patent is extended or adjusted under 35 U.S.C. 154(b) by 89 days.

(21) Appl. No.: 14/016,106

(22) Filed: Sep. 1, 2013

Related U.S. Application Data

(63) Continuation-in-part of application No. 13/924,373, filed on Jun. 21, 2013, now Pat. No. 8,832,876.

(60) Provisional application No. 61/827,577, filed on May 25, 2013.

(51) Int. Cl.
*A47C 19/00* (2006.01)
*A47C 19/12* (2006.01)

(52) U.S. Cl.
CPC ..... *A47C 19/12* (2013.01)
USPC ..... 5/400; 5/200.1; 5/202

(58) Field of Classification Search
USPC ..... 5/110, 200.1–202, 116, 117, 174–178, 5/286, 282.1, 156, 157, 181, 222
See application file for complete search history.

(56) References Cited

U.S. PATENT DOCUMENTS

| | | | | |
|---|---|---|---|---|
| 780,361 | A * | 1/1905 | Libotte | 5/183 |
| 985,355 | A * | 2/1911 | Lockhart | 5/183 |
| 1,554,098 | A | 9/1925 | Kaiserman | |
| 1,640,754 | A * | 8/1927 | Covey | 5/183 |
| 2,769,183 | A | 11/1956 | Froelich | 5/99.1 |
| 3,881,202 | A | 5/1975 | Tyhanic | 5/176.1 |
| 4,048,683 | A | 9/1977 | Chen | 5/180 |
| 4,654,905 | A | 4/1987 | Miller | 5/249 |
| 4,771,995 | A | 9/1988 | Wells et al. | 267/103 |
| 4,903,949 | A | 2/1990 | Schulz, Jr. | 267/103 |
| 6,076,210 | A | 6/2000 | Wu | 5/618 |
| 6,560,796 | B1 * | 5/2003 | Diforio | 5/200.1 |
| 7,363,666 | B2 | 4/2008 | Polevoy et al. | 5/311 |
| 7,376,988 | B2 | 5/2008 | Wickstrom et al. | 5/174 |
| 7,376,989 | B2 | 5/2008 | Wickstrom et al. | 5/250 |
| 7,406,727 | B2 | 8/2008 | Wickstrom et al. | 5/174 |
| 7,503,086 | B2 | 3/2009 | Wickstrom et al. | 5/250 |
| 7,739,760 | B2 | 6/2010 | Wang et al. | 5/176.1 |
| 7,784,122 | B2 | 8/2010 | Oh | 5/201 |
| 8,006,329 | B2 | 8/2011 | Oh | 5/201 |
| 8,006,330 | B2 | 8/2011 | Lee | 5/202 |
| 2006/0195982 | A1 * | 9/2006 | Cloer et al. | 5/202 |
| 2010/0235989 | A1 | 9/2010 | Jin | 5/174 |

* cited by examiner

*Primary Examiner* — Nicholas Polito
*Assistant Examiner* — Richard G Davis
(74) *Attorney, Agent, or Firm* — Imperium Patent Works; Darien K. Wallace

(57) ABSTRACT

An adjustable, collapsible mattress support for a box spring has cross bars with slidably connected sections. A first section of each cross bar is fixedly attached to a band that folds around the second section and slides along the second section. A bolt that passes through holes in the second section slides into a slot in the band. By aligning the slot over one of the holes through which the bolt passes, the length of the cross bars can be adjusted to accommodate the widths of different sized box springs and mattresses. The first section is fixedly attached to a hinge plate. First and second bars are pivotally attached to the plate. The first and second bars pivot about parallel axes that pass through the plate at separate fixed locations and that are orthogonal to the plate. The mattress support accommodates full, Queen, California King and Eastern King sized mattresses.

20 Claims, 15 Drawing Sheets

ADJUSTABLE, COLLAPSIBLE, COMPACT MATTRESS SUPPORT

CROSS REFERENCE TO RELATED APPLICATION

This application is a continuation-in-part of, and claims priority under 35 U.S.C. §120 from, nonprovisional U.S. patent application Ser. No. 13/924,373 entitled "A Collapsible, Compact Mattress Support," filed on Jun. 21, 2013. Application Ser. No. 13/924,373, in turn, claims priority under 35 U.S.C. §119 from U.S. Provisional Application No. 61/827,577, entitled "A Collapsible Compact Bed Frame," filed on May 25, 2013. The subject matter of each of the foregoing documents is incorporated herein by reference.

TECHNICAL FIELD

The described embodiments relate to bedding products, and more particularly to a sturdy bed frame assembled from components that are packaged in a compact form for ease of storage and transportation.

BACKGROUND

Conventional bed frames are relatively heavy and awkward. FIG. 1 (prior art) shows the structure of a conventional bed frame 10 including two opposing side rails 11 with a plurality of cross bar members 12 extending between the side rails. Bed frame 10 also includes a center beam 13 that is parallel to the side rails and located at the center of the bed frame in order to provide additional support to a box spring and mattress. The side rails 11 and cross bar members 12 are typically formed from elongated pieces of steel having an L-shaped cross-section (also called angle iron). A horizontal flange of each side rail 11 supports the box spring, and a vertical flange prevents each side rail from bending under the weight of the box spring, the mattress and the occupants of the bed. Thus, the angular arrangement of the side rails is required for structural integrity. In addition, downwardly extending support legs typically screw into threaded leg holders attached to cross bar members 12, center beam 13 and/or side rails 11. The bed frame 10 may support the box spring on wooden slats spanning between the side rails or may directly accommodate the box spring.

The cross bar members 12 are typically formed from multiple sections of the L-shaped metal that overlap each other and can be adjusted to the width of the mattress. Where a king size or California king size mattress is to be supported, each cross bar member 12 includes an extension bar 14 that spans between the other sections of the cross bar member in order to achieve the required length of the assembled cross bar member to span the distance between the side rails 11 to accommodate the larger size box spring and mattress. If two cross bar members 12 were made sufficiently long to accommodate a king or California king size bed without using an extension bar, the cross bar members 12 would be too long for a small bed frame and would extend outwardly beyond the normal width of those bed frames.

When center beam 13 is added to side rails 11, screws are inserted through the mated cross bar members 12 to connect the side rails 11 and to secure center beam 13 to bed frame 10. While the cross bar members 12 are made up of multiple pieces, however, each side rail 11 of a conventional bed frame is a single piece of metal about as long as the box spring and mattress that are to be supported. In order to maintain stability, the side rails of conventional bed frames are not made of multiple overlapping pieces. Thus, the length of the box in which a conventional bed frame is packaged is about as long as the mattress that is to be supported.

Conventional bed frames are typically assembled at the location of the bed. The assembly process can be cumbersome because it usually involves many non-intuitive steps and requires the use of multiple tools. The manner in which multiple pieces are connected to form the cross bar members 12 is typically complicated and can require tools. In addition, the support legs must be screwed or bolted to the cross bar members 12 or side rails 11. Another shortcoming of conventional bed frames is a relatively heavy weight, due primarily to the weight of the steel from which side rails 11 and cross bar members 12 are made. The heavy weight results in higher shipping costs and difficulty of assembly.

Thus, a bed frame assembly is sought that overcomes the shortcomings of conventional bed frames, such as the long length of the packing box for the bed frames, the heavy weight of the bed frames and the complicated assembly that can require tools. The compact, light weight and easily assembled bed frame should nevertheless be sturdy.

SUMMARY

A collapsible, compact mattress support is strong, sturdy and easy to assemble. The mattress support includes hinge plates on opposite sides of a middle cross bar. The plates are coplanar. First and second side bars are pivotally attached to one hinge plate, and third and fourth side bars are pivotally attached to the other hinge plate. Each of the bars rotates about axes that are parallel to one another and orthogonal to the hinge plates. Each of the four side bars has a common width. A first distance between the axes about which the first and second bars rotate equals a second distance between the axes about which the third and fourth bars rotate plus twice the common width of the bars. In one embodiment, the cross bars each have two sections and are extendable. The two sections either slide by each other on the sides or telescope into one another.

In another embodiment, a foldable mattress support includes a first plate fixedly attached to a cross bar. A first side bar is pivotally attached to the first plate and pivots about a first axis, and a second side bar is also pivotally attached to the first plate but pivots about a second axis. Each of the first and second axes is orthogonal to the first plate and passes through the first plate at a separate fixed location. A clasp is adapted to lock the first side bar to the second side bar such that the first side bar is oriented parallel to the second side bar and perpendicular to the cross bar. When the clasp is unlocked and the foldable mattress support is folded, the first side bar and the second side bar are substantially parallel to the cross bar.

Four holes pass through the first plate and are oriented in a line. The first axis and the second axis pass through the inner two of the four holes. The first and second side bars are pivotally attached to the first plate by bolts that pass through the inner two of the four holes. But no bolts pass through the outer two of the four holes.

The foldable mattress support also includes a second plate fixedly attached to the cross bar at the end opposite the first plate. A third side bar is pivotally attached to the second plate and pivots about a third axis, and a fourth side bar is also pivotally attached to the second plate but pivots about a fourth axis. Each of the third and fourth axes is orthogonal to the second plate and passes through the second plate at a separate fixed location. The first, second, third and fourth side bars all have equal widths. The third axis is a distance from the fourth axis that equals the width of the cross bar plus three times the width of the side bars.

The mattress support can be assembled for use from a kit of components. The components are nested together in a compact packing box for ease of storage and transportation. Therefore, storage space requirements and shipping bulk are reduced. The components of the mattress support with extendable cross bars for accommodating Queen, California King and Eastern King sized box springs and mattresses fit in a packing box whose length is no greater than forty-five inches and whose width and height are each no more than seven inches. The components of the mattress support with non-extendable cross bars for accommodating a twin size box springs and mattress fit in a packing box whose length is no greater than thirty-nine inches.

The packing box containing the collapsible mattress support can be carried by a single purchaser. The components that are packaged into the packing box include side bars, cross bars, support legs and edge attachments. A first plate and a second plate are attached to opposite ends of a middle cross bar. First and second side bars are pivotally connected to the first plate, and third and fourth side bars are pivotally connected to the second plate. The first and second side bars pivot about parallel axes that are orthogonal to the first plate, the third and fourth side bars pivot about parallel axes that are orthogonal to the second plate. The axes about which the first and second side bars pivot are spaced farther apart than the axes about which the third and fourth side bars pivot.

The purchaser of the collapsible mattress support is instructed to remove the folded and collapsed mattress support from the packing box, to assemble the collapsible mattress support, and to place a box spring on top of the assembled collapsible mattress support.

In another embodiment, an adjustable, collapsible mattress support for a box spring has cross bars that each have two slidably connected sections. A first section of each cross bar is fixedly attached to a first band that folds around the second section and slides along the second section. A bolt that passes through holes in the second section is aligned to slide into a slot in the first band. In addition, a second band is attached to the second section and folds around the first section and slides along the first section. By sliding the first section past the second section until the base of the slot is aligned over one of the holes through which the bolt passes, the length of the cross bars can be adjusted to accommodate the widths of different sized box springs and mattresses. The first section is fixedly attached to a plate of a hinge. First and second bars are pivotally attached to the plate. The first bar pivots about a first axis, and the second bar pivots about a second axis. Each of the first axis and the second axis is orthogonal to the plate and passes through the plate at a separate fixed location.

In another embodiment, the adjustable mattress support has a cross bar, a plate and first and second bars. The cross bar has a first section and a second section that are slidably connected to one another. The first section is fixedly attached to a first band that wraps around the second section and slides along the second section. The second section has a surface through which a first hole and a second hole pass. The first band includes a slot with a base that aligns over the first hole or the second hole depending on how far the first section is slid along the second section. The plate is fixedly attached to the second section. The first bar is pivotally attached to the first plate and pivots about a first axis. The second bar is pivotally attached to the first plate and pivots about a second axis. Each of the first axis and the second axis is orthogonal to the first plate and passes through the first plate at a separate fixed location.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
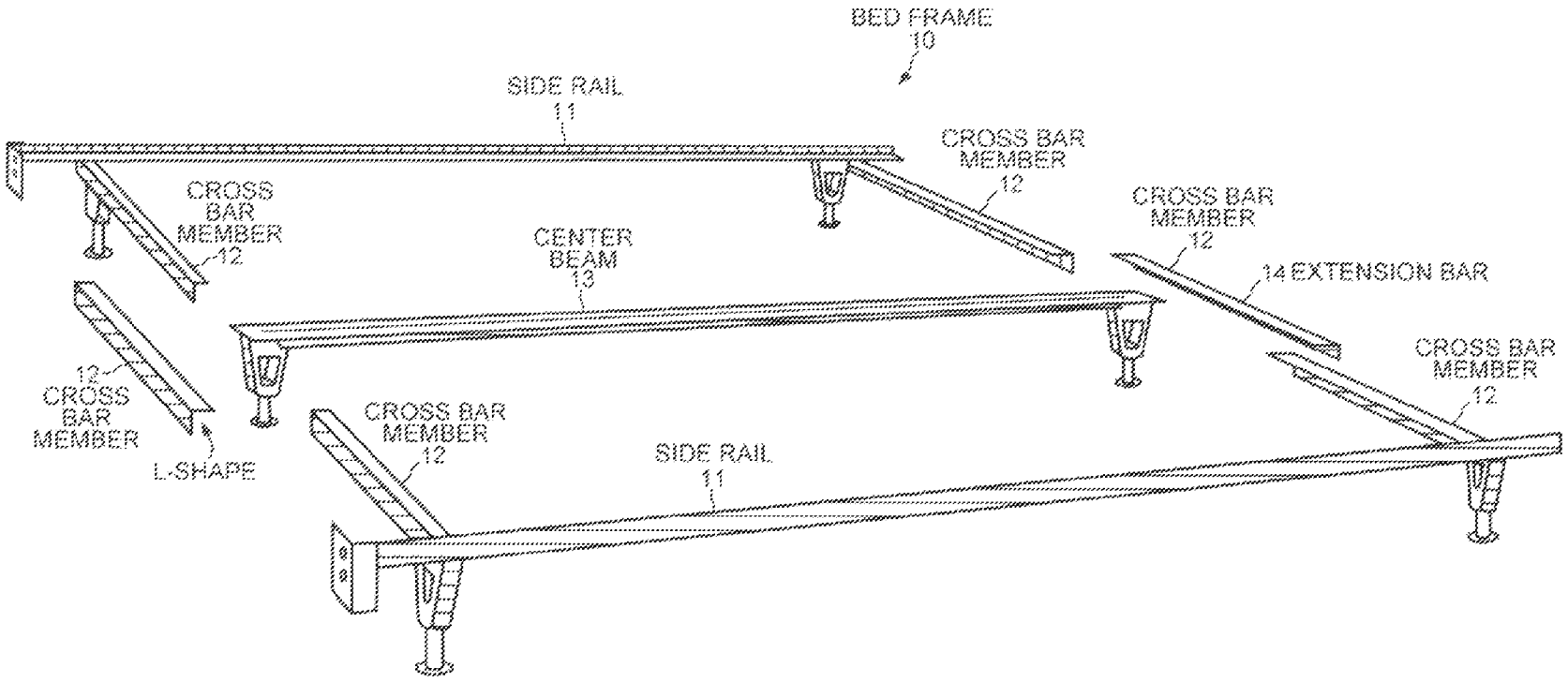
(PRIOR ART) FIG. 1
FIG. 1 (prior art) is a perspective view of a prior art bed frame with long side rails.
Figure 2:
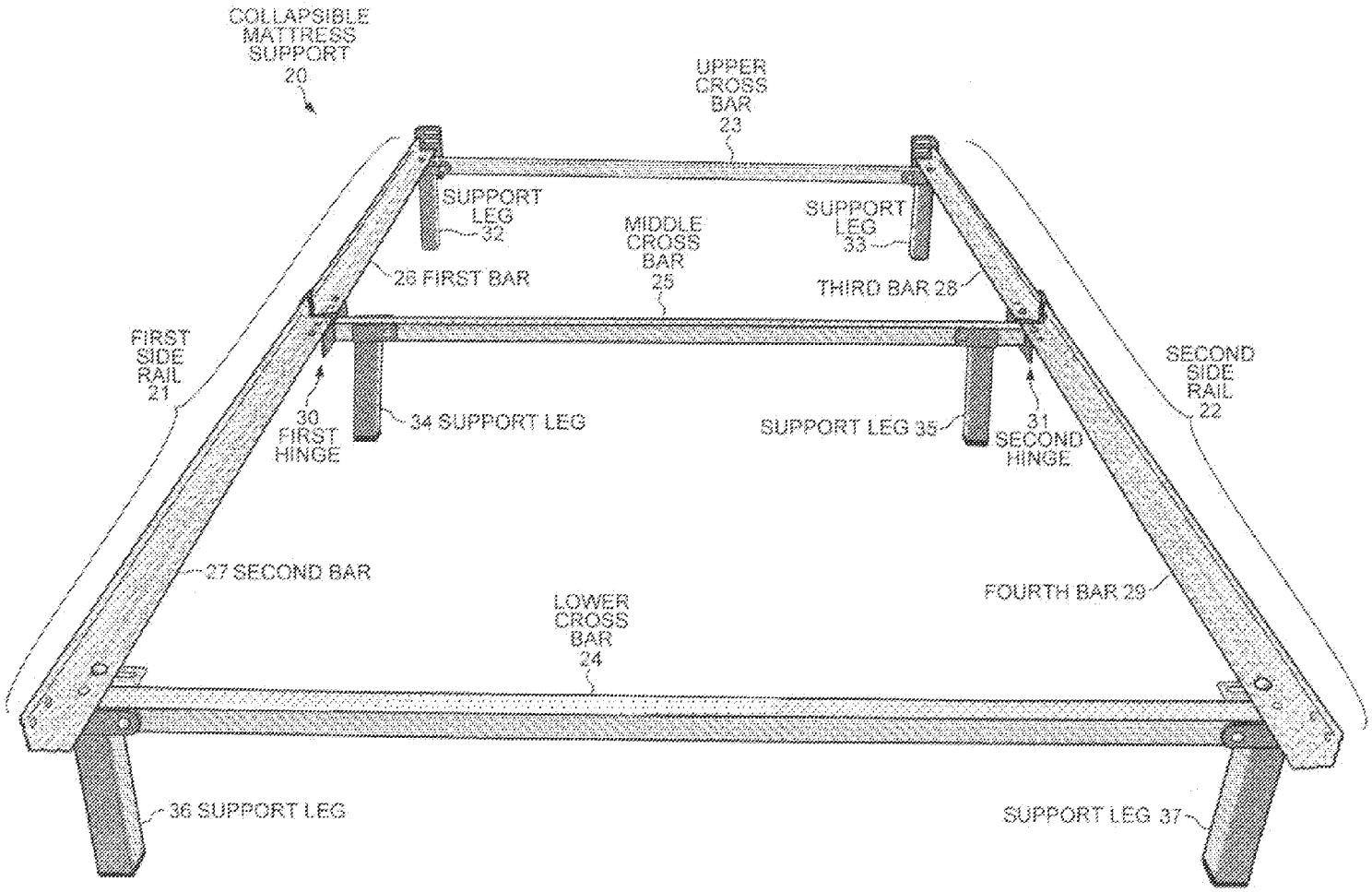
FIG. 2 is a perspective view of a collapsible, compact mattress support with folding side bars.

FIG. 2 shows a collapsible, compact mattress support 20. Mattress support 20 includes a first side rail 21, a second side rail 22, an upper cross bar 23, a lower cross bar 24 and a middle cross bar 25. First side rail 21 includes a first bar 26 and a second bar 27. Second side rail 22 includes a third bar 28 and a fourth bar 29. FIG. 2 shows mattress support 20 in an assembled condition. In the assembled condition, first side rail 21 is parallel to second side rail 22. In addition, upper cross bar 23, middle cross bar 25, and lower cross bar 24 are parallel to each other. Middle cross bar 25 is attached to first bar 26 and second bar 27 at a first hinge 30. In addition, middle cross bar 25 is attached to third bar 28 and fourth bar 29 at a second hinge 31. Even in the collapsed condition in which mattress support 20 is shipped, middle cross bar 25 remains pivotally connected to all of first bar 26, second bar 27, third bar 28 and fourth bar 29. In the collapsed condition in which mattress support 20 is shipped, upper cross bar 23 is separated from first bar 26 and third bar 28, and lower cross bar 24 is separated from second bar 27 and fourth bar 29.

Mattress support 20 has six folding support legs that can pivot from a folded position to an extended position. Two hinged support legs 32-33 are pivotally attached to upper cross bar 23. Hinged support legs 34-35 are pivotally attached to middle cross bar 25. And hinged support legs 36-37 are pivotally attached to lower cross bar 24. In the assembled condition of mattress support 20 shown in FIG. 2, each of support legs 32-37 is in the extended position.

Figure 3:
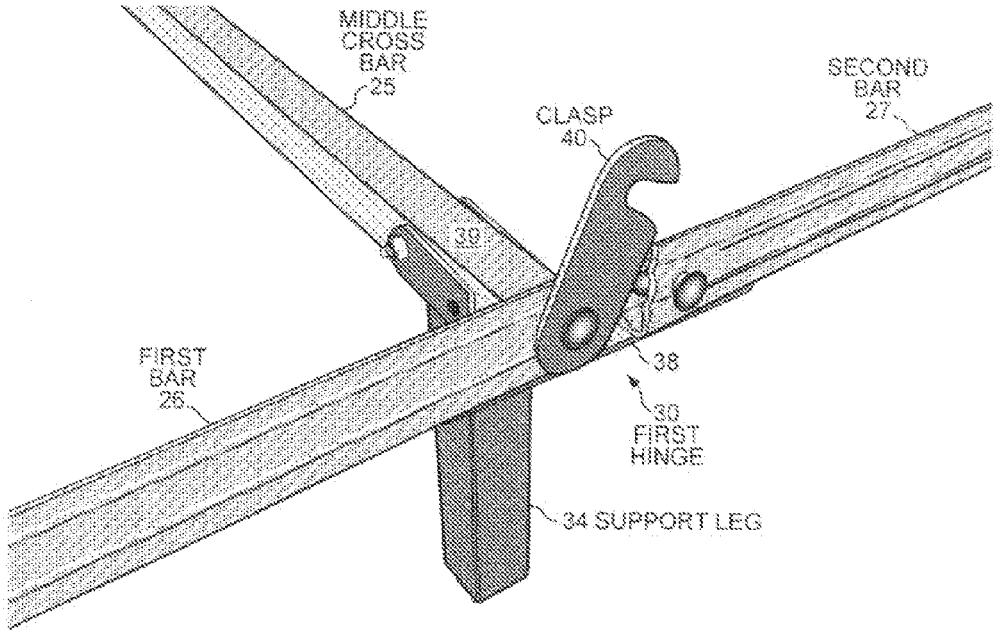
FIG. 3 is a more detailed view of a hinge attached to a cross bar of the mattress support of FIG. 2.

FIG. 3 shows middle cross bar 25, first bar 26, second bar 27 and first hinge 30 in more detail. First hinge 30 is fixedly attached to middle cross bar 25 and pivotally connects first bar 26 to second bar 27. First hinge 30 is an angled piece of metal with a plate 38 that is coplanar with the top surface 39 of middle cross bar 25. A clasp 40 is adapted to lock first bar 26 to second bar 27 when mattress support 20 is in the assembled condition. Clasp 40 is open in FIG. 3. When clasp 40 locks first bar 26 to second bar 27, first bar 26 is oriented parallel to second bar 27 and perpendicular to middle cross bar 25. In FIG. 3, hinged leg support 34 is in the extended position and is supporting middle cross bar 25.

Figure 4:
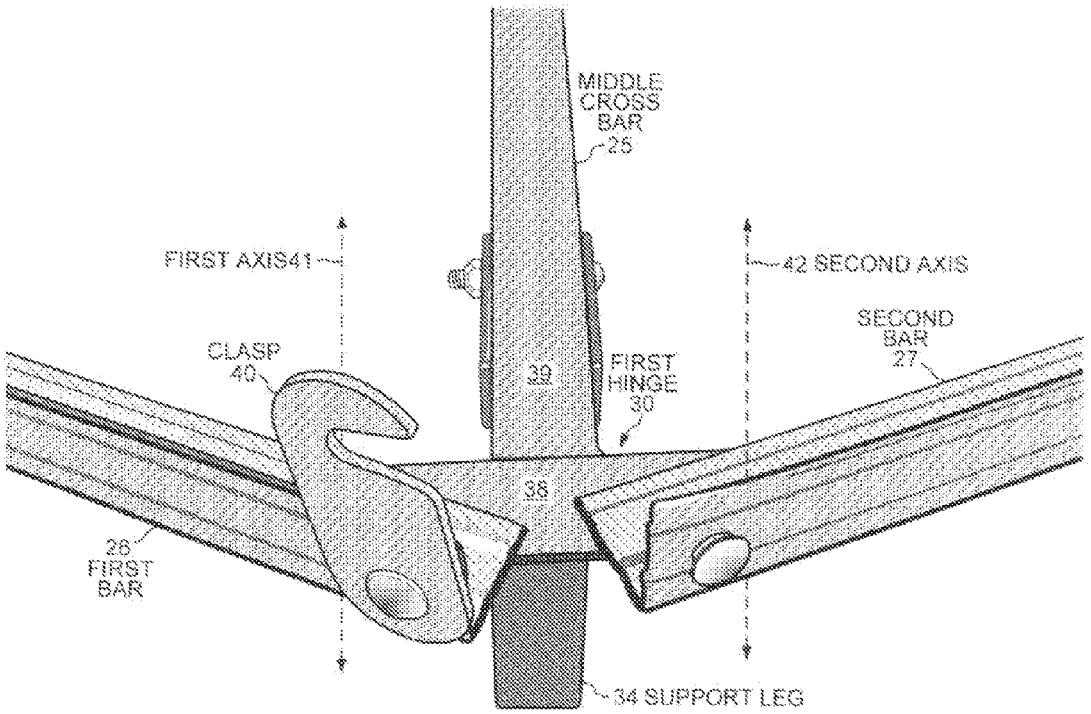
FIG. 4 is a more detailed view of the hinge of FIG. 3. to which two side bars are pivotally attached.

FIG. 4 shows first hinge 30 from above with first bar 26 and second bar 27 partially folded. Clasp 40 is open in FIG. 4. First hinge 30 is a sheet of metal angled at ninety degrees with the top of one plate 38 coplanar to top surface 39 of middle cross bar 25 and the other perpendicular plate welded to the end of middle cross bar 25. First bar 26 is pivotally attached to plate 38 and pivots about a first axis 41. Second bar 27 is pivotally attached to plate 38 and pivots about a second axis 42. Each of first axis 41 and second axis 42 is orthogonal to plate 38 and passes through plate 38 at a separate fixed location. Each of first, second, third and fourth bars 26-29 is an elongated piece of steel having an L-shaped cross-section (also called an angle iron). Each of bars 26-29 has the same dimensions. The horizontal portions of L-shaped bars 26-27 are oriented parallel to plate 38. The axes 41-42 pass through the middle of the width of the horizontal portions of L-shaped bars 26-27. The distance between first axis 41 and second axis 42 equals the widths of the horizontal portions of L-shaped bars 28-29 plus the width of middle cross bar 25 plus half of the widths of the horizontal portions of L-shaped bars 26-27. Thus, the distance between axes 41 and 42 equals three times the width of an L-shaped bar 26-29 plus the width of middle cross bar 25.

Figure 5:
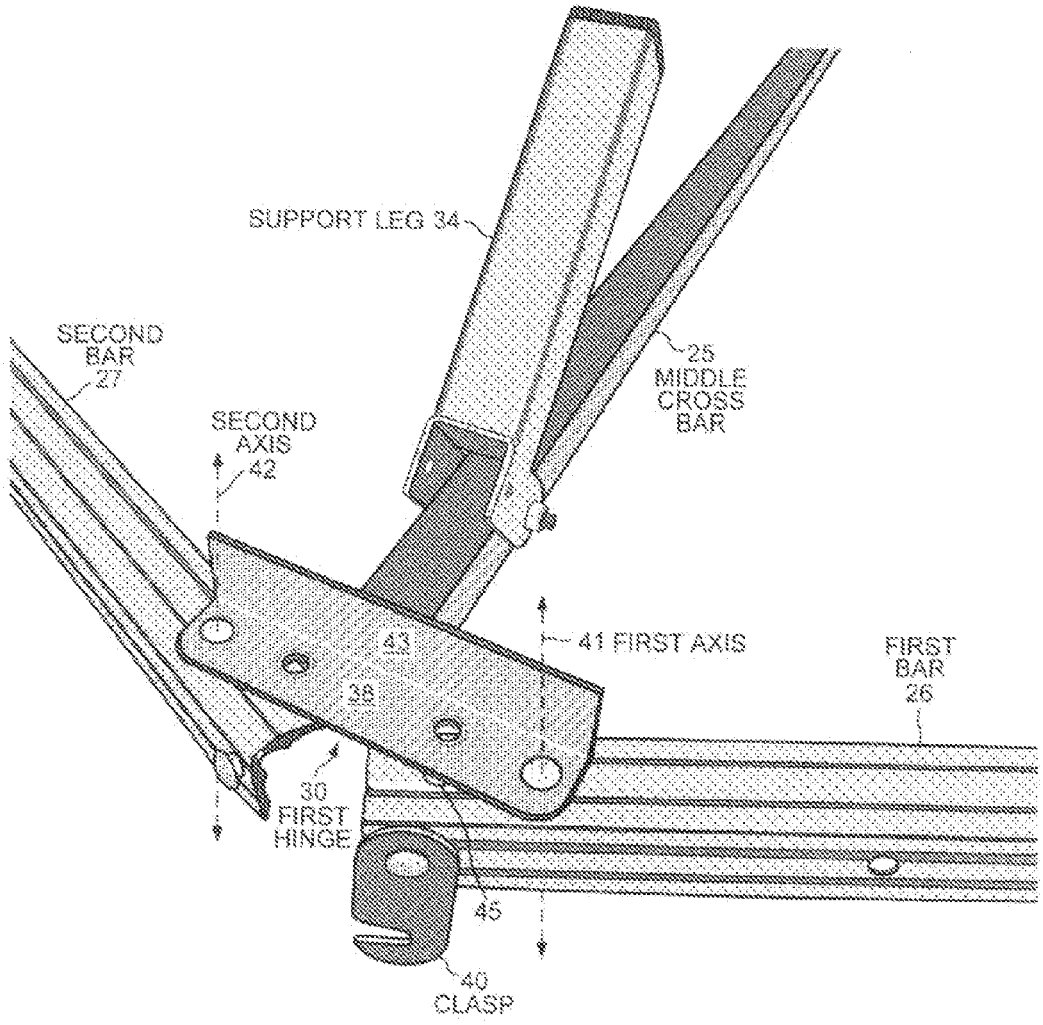
FIG. 5 shows the hinge of FIG. 3 from below with two side bars partially folded.

FIG. 5 shows first hinge 30 from below with first bar 26 and second bar 27 partially folded. FIG. 5 shows the vertical plate 43 of first hinge 30 that is welded to the end of middle cross bar 25. Support leg 34 is partially folded in towards middle cross bar 25. Horizontal plate 38 includes four holes, as does the horizontal plate 44 of second hinge 31 at the opposite side of middle cross bar 25. The middle two holes through plate 38 are not used on first hinge 30, and the outer two holes through plate 44 are not used on second hinge 31. Axis 41-42 pass through the outer two holes in plate 38 so as to provide sufficient space for bars 28-29 to fold from second hinge 31 parallel to middle cross bar 25 inside of bars 26-27 that fold from first hinge 30 in the collapsed state of mattress support 20.

Each of bars 26-29 has two holes at the end of its horizontal portion and at the end of its vertical portion. The horizontal and vertical portions of the L-shaped bars are interchangeable depending on which of the bars 26-29 is attached to which of the hinges 30-31. The holes closest to the ends of the horizontal portions of bars 26-27 are not used to attach the bars to first hinge 30. A portion of the unused end hole 45 in first bar 26 is apparent in FIG. 5. Placing four holes in the horizontal plates of both hinges 30-31 and placing two holes at each end of the bars 26-29, even though only half of the holes are used, allows mattress support 20 to be made from standard parts and reduces the cost of manufacturing.

Figure 6:
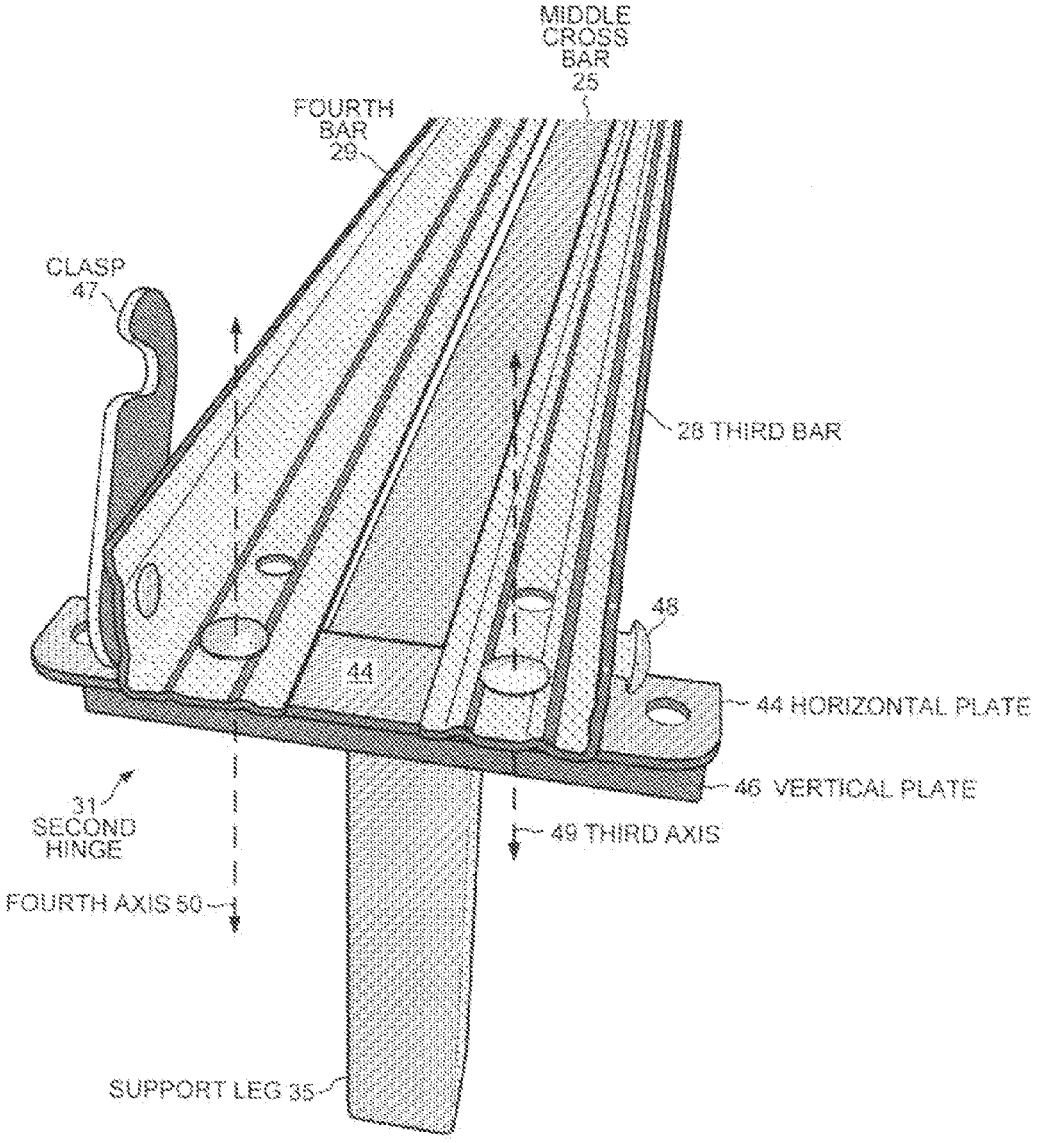
FIG. 6 is a detailed view of a second hinge that is pivotally connected to two side bars on the opposite side of the mattress support of FIG. 2.

FIG. 6 shows second hinge 31 in more detail. In FIG. 6, third bar 28 and fourth bar 29 are folded in parallel to middle cross bar 25, and support leg 35 is extended perpendicular to middle cross bar 25. A clasp 47 on fourth bar 29 is open. In the assembled state, clasp 47 clips over a knob 48 on third bar 28 and locks third bar 28 and fourth bar 29 parallel to each other and perpendicular to middle cross bar 25. However, in FIG. 6, third bar 28 and fourth bar 29 are in the collapsed state and are parallel to each other and parallel to middle cross bar 25.

A vertical plate 46 of second hinge 31 is welded to the end of middle cross bar 25 opposite first hinge 30. Horizontal plate 44 includes four holes located along the center line. The outer two holes through plate 44 are not used on second hinge 31. A third axis 49 passes through one of the inner holes, and a fourth axis 50 passes through the other of the inner holes. The axes 41-42 and 49-50 pass through the centers of bolts that pass through the holes and pivotally connect the bars 26-29 to the plates 38 and 44. Third bar 28 is pivotally attached to plate 44 and pivots about third axis 49. Fourth bar 29 is pivotally attached to plate 44 and pivots about fourth axis 50. Each of third axis 49 and fourth axis 50 is orthogonal to plate 44 and passes through plate 44 at a separate fixed location. The distance between third axis 49 and fourth axis 50 equals the width of middle cross bar 25 plus half of the two widths of the horizontal portions of L-shaped bars 28-29. Thus, the distance between axes 41 and 42 equals the width of an L-shaped bar 26-29 plus the width of middle cross bar 25.

Figure 7:
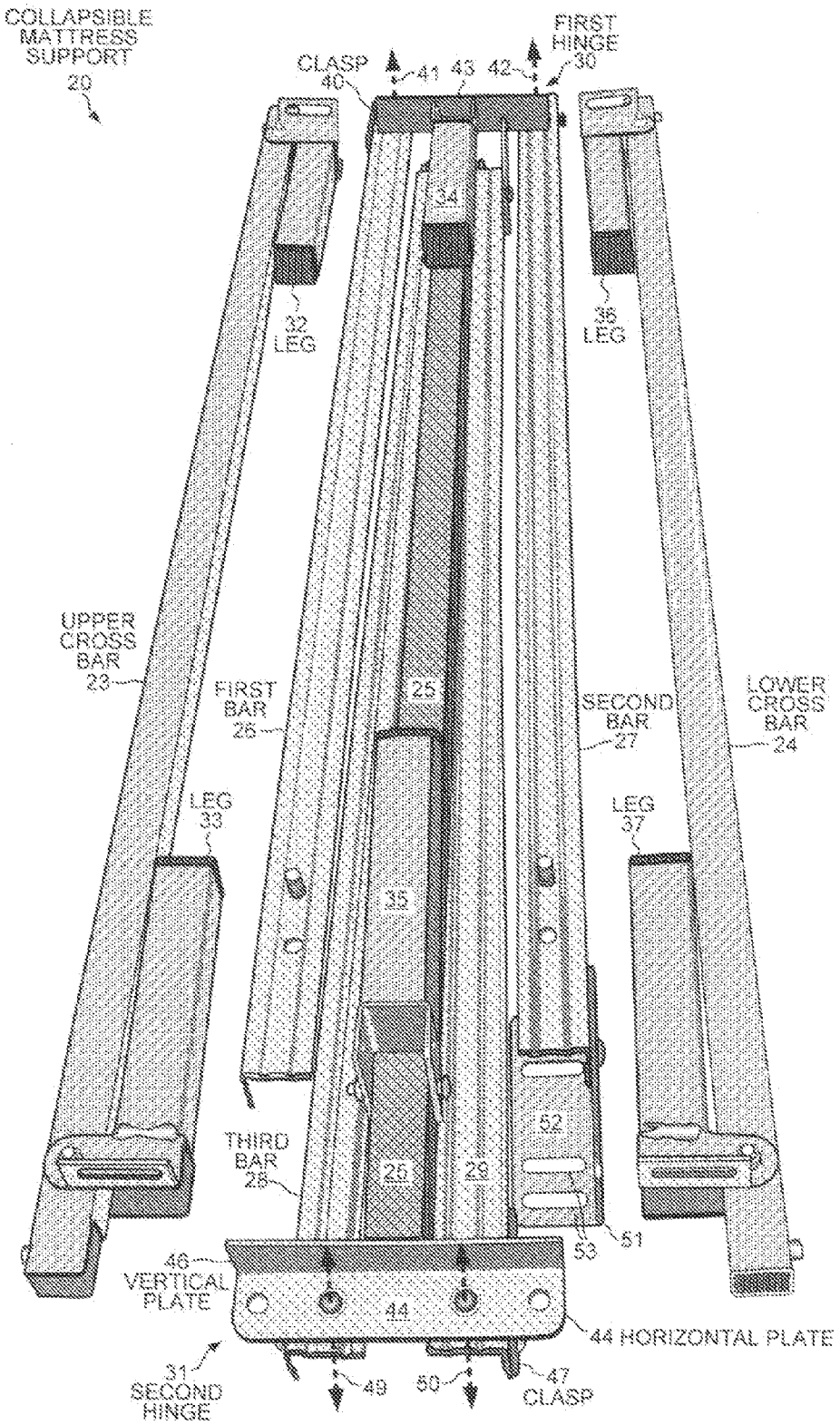
FIG. 7 shows the components of the mattress support of FIG. 2 in a folded condition as they would be placed in a packing box.

FIG. 7 shows the components of mattress support 20 in a folded condition as they would be placed in a packing box. All of the support legs 32-37 are folded in parallel to the cross bars 23-25 in the collapsed state in which mattress support 20 is packed in the packing box. As shown in FIG. 7, third bar 28 and fourth bar 29 fold in adjacent to middle cross bar 25, and first bar 26 and second bar 27 fold in adjacent to third bar 28 and fourth bar 29, respectively. The total width of collapsed mattress support 20 that fits in a packing box is four times the width of a bar 26-29 plus the width of middle cross bar 25. Upper cross bar 23 and lower cross bar 24 can be placed on top of the bars 26-29 in the packing box. For bars 26-29 that are 1.5 inches wide, a packing box that is no wider than seven inches can be used.

FIG. 7 shows edge attachments that are attached to the ends of second bar 27 and fourth bar 29. Edge attachments are also attached to the ends of first bar 26 and third bar 28, but they are not shown in FIG. 7. For example, an edge attachment 51 is attached to the end of second bar 27. Edge attachment 51 has an end plate 52 with slots 53. Edge attachment 51 is attached to bar 27 by a rivet or bolt so that attachment 51 can be rotated with its longer dimension parallel to bar 27 when mattress support 20 is in the folded condition. In the assembled condition, attachment 51 can be rotated so that its longer dimension is perpendicular to bar 27. Edge attachment 51 can be secured in the perpendicular orientation by another bolt through a second hole in bar 27. The edge attachments prevent the box spring sitting on mattress support 20 from sliding towards the head or foot of the bed. In addition, a headboard can be attached to edge attachment 51 and to the edge attachment at the end of fourth bar 29. Tongues on the headboard slip into the slots 53 in the edge attachments.

FIG. 7 shows the four holes arranged in a line that pass through horizontal plate 44 of second hinge 31. Third bar 28 and fourth bar 29 are pivotally attached to plate 44 by bolts that pass through the inner two of the four holes, but no bolts pass through the outer two of the four holes. The outer two holes are not used in second hinge 31. Each of first bar 26, second bar 27, third bar 28 and fourth bar 29 has a common width. The centers of the outer two holes are separated by a distance that equals the distance between the inner two holes plus twice the common width of the bars 26-29.

Various embodiments of mattress support 20 are designed to accommodate different sized mattresses. For example, a twin (single) size mattress is thirty-nine inches wide and seventy-five inches long. So the distance across middle cross bar 25 from the outer edge of horizontal plate 38 to the outer edge of horizontal plate 44 is about thirty-nine inches in order to accommodate a twin size mattress. The outer edges of plates 38 and 44 are as far apart as the vertical portions of L-shaped first bar 26 and third bar 28, between which the box spring fits. To support a twin size mattress, for example, a box spring with the same rectangular dimensions is used. In order to achieve the shortest length of the bars that support the longer dimension of the mattress, the first and second bars and the third and fourth bars are made to have approximately equal lengths. Thus, each of the bars 26-29 is about 36.5 inches long for a twin size mattress, which is somewhat shorter than the thirty-nine inch length of middle cross bar 25 plus the attached hinges 30-31. The edge attachments at the head and foot of mattress support 20 together add an additional one inch to the combined length of the side bars. In addition, there is an additional inch of clearance between first and second bars 26-27 and between third and fourth bars 28-29 that allows the bars to rotate past each other. Thus, the two 36.5-inch side bars plus the inch of middle clearance plus the inch added by the edge attachments combines to accommodate box springs for a twin size mattress having a length of seventy-five inches. The mattress support 20 that accommodates a twin size box spring and mattress fits in a packing box that is thirty-nine inches long, seven inches wide and three inches tall.

The components of mattress support 20 fit into a compact, light-weight packing box that is smaller and weighs less than the packing box containing conventional mattress support 10. Each side rail 11 of conventional mattress support 10 is a single piece of angle iron. Thus, the packing box for conventional bed frames is typically more than seventy-five inches long. In contrast, the packing box containing mattress support 20 in a folded condition has a length that is no longer than thirty-nine inches. The length of the packing box for mattress support 20 that accommodates a twin size mattress is the width of the mattress. However, for versions of mattress support 20 that accommodate larger mattresses, the middle cross bar is made extendable or telescoping so that the mattress support can fit in a packing box whose length is less than the width of the corresponding mattress.

Figure 8:
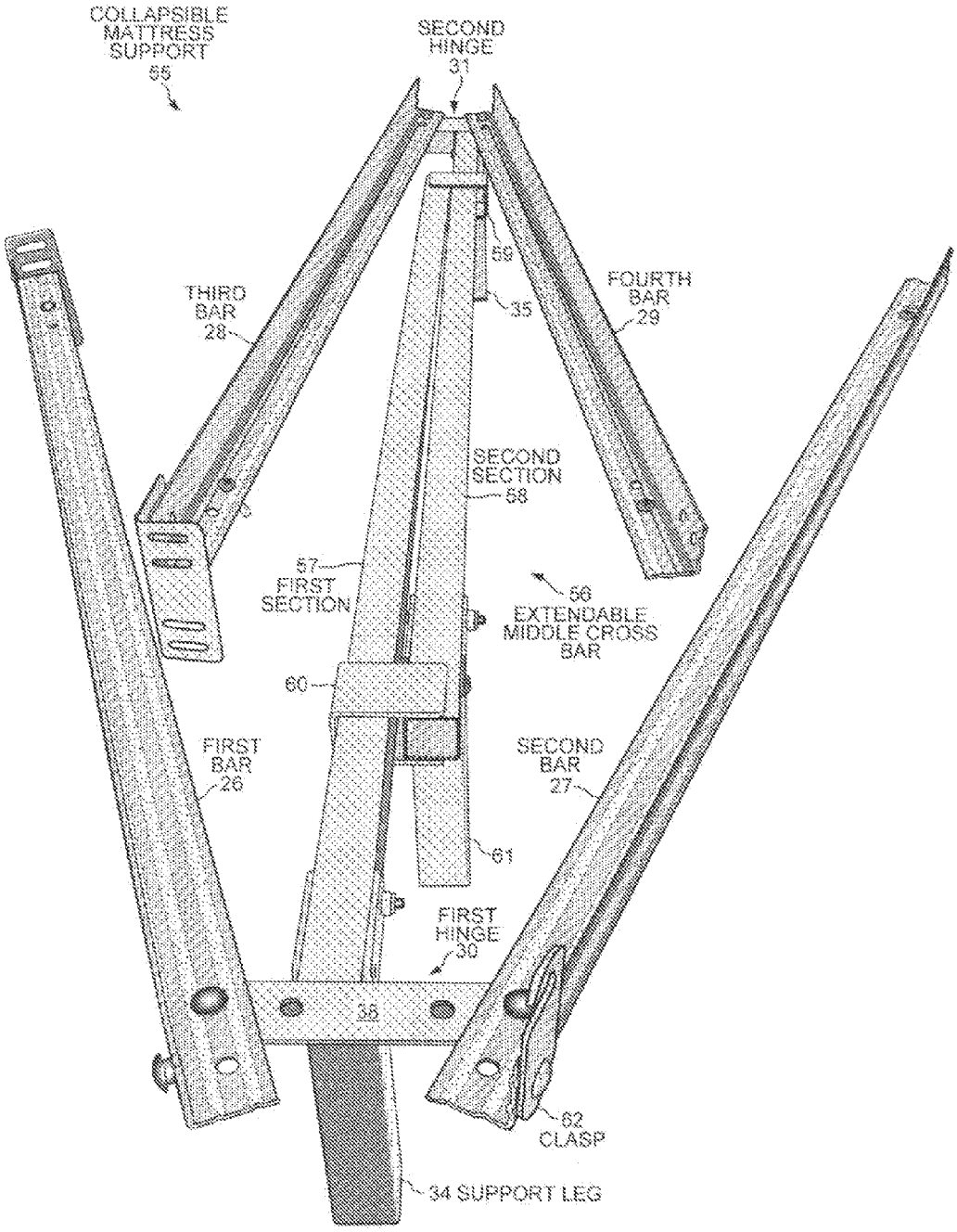
FIG. 8 is a perspective view of a second embodiment of a collapsible mattress support with extendable cross bars.

FIG. 8 shows a second embodiment of a collapsible mattress support 55 with extendable cross bars. The extendable cross bars allow mattress support 55 to fit in a packing box whose length is about half of the length of the mattress that the mattress support supports. In order to achieve the shortest length of the side bars that support the longer dimension of the mattress, the first and second bars and third and fourth bars are made to have approximately equal lengths. Thus, each of the side bars is about half as long as the mattress that is to be supported. For example, a version of mattress support 55 that accommodates a California King size mattress can fit in a packing box that is no longer than forty-two inches. A California King size mattress is seventy-two inches wide and eighty-four inches long. A unitary cross bar would be seventy-two inches from the outer edges of that horizontal plates of the opposing first and second hinges. However, an extendable cross bar can be compressed in the folded state to be shorter than the 41-inch side bars required to support an 84-inch long California King size box spring and mattress. (The head and foot edge attachments add an additional one inch to the total length of the side bars, and another inch of clearance is added between the bars at the hinges.) So the 41-inch side bars are the longest components that must fit inside the packing box for a mattress support that accommodates a California King size box spring and mattress. Both sections of the extendable cross bars can be forty inches long, which allows for an overlap of eight inches in order to extend to the 72-inch width of a California King size mattress.

FIG. 8 shows the extendable middle cross bar 56 of collapsible mattress support 55. Middle cross bar 56 includes two sliding cross bar sections 57-58. The upper and lower cross bars of mattress support 55 are also extendable and have first and second sections. First section 57 of middle cross bar 56 includes a band 59 that folds around second section 58. Second section 58 includes a band 60 that folds around first section 57. The bands 59-60 slide along the outside of the cross bar sections 57-58 that have square cross sections. Each cross bar section 57-58 has two folding support legs. For example, support leg 35 and a second support leg 61 are pivotally attached to second section 58. Vertical plate 43 of first hinge 30 is welded to the end of first section 57. And the vertical plate of second hinge 31 is welded to the end of section 58. The hook of a clasp 62 is pivotally attached to second bar 27 in the embodiment of FIG. 8 instead of to first bar 26 as in the embodiment of FIG. 4. By sliding first section 57 past second section 58, the length of middle cross bar 56 can be adjusted to accommodate the widths of various sized mattresses, such as Queen size (60-inch width), California King size (72-inch width) and Eastern King size (76-inch width).

Figure 9:
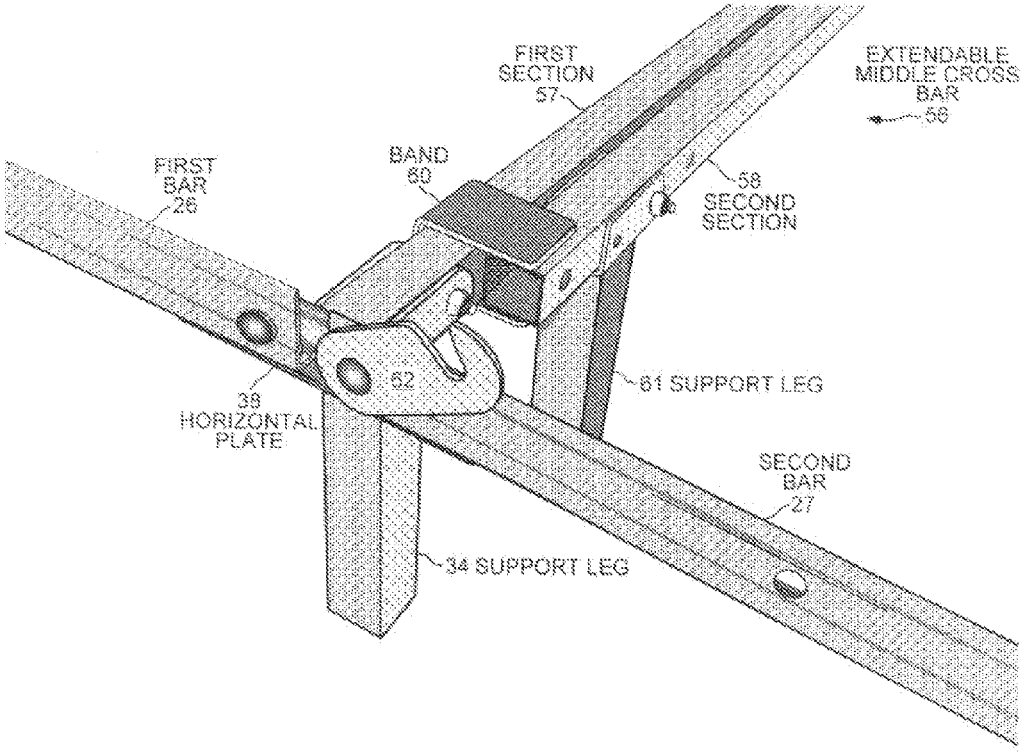
FIG. 9 is a more detailed view of a hinge of the mattress support of FIG. 8 that is attached to an extendable cross bar.

FIG. 9 is a more detailed view of first hinge 30 that is attached to first section 57 of middle cross bar 56. FIG. 9 shows that band 60 is welded to the top and bottom surfaces of second section 58 of middle cross bar 56. Each of first and second sections 57-58 is a hollow tube of steel having a square cross section with sides about one inch wide. First section 57 slides through band 60 as middle cross bar 56 is extended after removal from the packing box. The sections of middle cross bar 56 are almost completely collapsed in the view of FIG. 9, but would be extended in the assembled condition of mattress support 55. The sections of the cross bars are not removed from each other in the folded condition in the packing box; rather, they are collapsed and compressed.

In another embodiment, the sections of extendable cross bars fit inside each other in a telescoping manner. Because one section fits inside the other section, only the outer section has an additional folding support leg. Thus, the embodiment of mattress support 55 with telescoping cross bars that slide into each other has nine support legs instead of the twelve support legs of the embodiment with cross bar sections whose sides slide past each other. The upper middle and lower cross bars can be extended to different lengths by inserting the first section of the cross bar farther into the second section of the cross bar. By adjusting the length of the cross bars, collapsible mattress support 55 can accommodate box springs and mattresses of multiple sizes. To maintain the stability of the cross bars, however, some distance of the first section must remain telescoped inside the second section. In one implementation, at least ten inches of second section must remain overlapping first section to maintain the stability of the cross bar and ultimately the mattress support 55.

Figure 10:
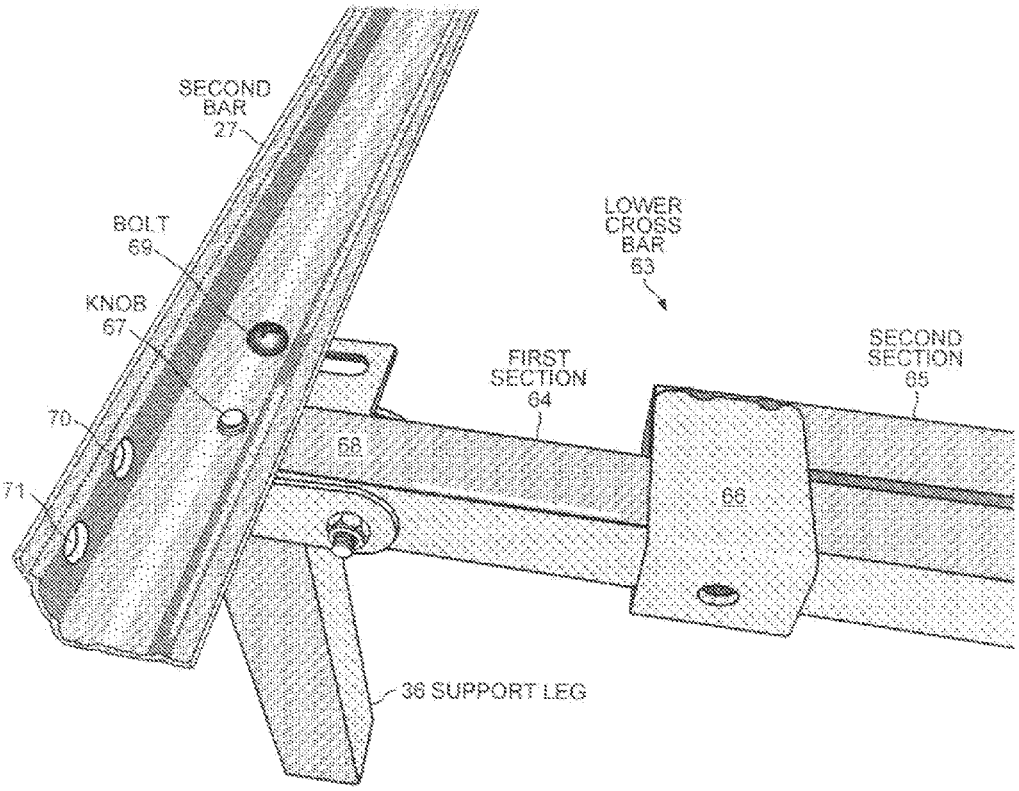
FIG. 10 shows a lower extendable cross bar of the mattress support of FIG. 8 that is attached to a side bar.

FIG. 10 illustrates how a lower cross bar 63 of mattress support 55 is attached to second bar 27. Lower cross bar 63 includes a first section 64 that is slidably attached to second section 65 by a first band 66 and a second band. First section 64 includes a knob or the end of a bolt 67 that protrudes a short distance above the top surface 68 of first section 64. Knob 67 passes up through a first hole in the horizontal portion of L-shaped second bar 27. A bolt 69 passes down through a second hole in the horizontal portion of second bar 27 and is secured by a wing nut. There are also two unused holes 70-71 in the vertical portion of L-shaped second bar 27. The holes 70-71 are placed at the end of second bar 27 because all of the side bars 26-29 are standardized and can be used in any orientation. For example, second bar 27 could be flipped end-to-end such that first hinge 30 would be pivotally attached to second bar 27 by a bolt through hole 70 through which the second axis 42 would pass.

By assembling the components of mattress support 20 or 55 only after the packing box has been transported to the location of the box spring to be supported, damage to stair wells, elevators and doorways can be avoided. The long and heavy side rails 11 of conventional bed frame 10, and even the packing box containing the bed frame 10, are difficult to maneuver without damaging stair wells, elevators and doorways. The packing box containing the components of mattress support 20 or 55 is more easily maneuvered up stairs, into apartment elevators and around corners. In addition, the packing box containing the components of mattress support 20 or 55 is so light and compact that it can lifted by the average customer in a mass-market, general merchandise retail store (a discount department store) into a shopping cart and taken to the check-out counter. Thus, mattress supports 20 and 55 can be sold in discount department stores without customer assistance, whereas conventional bed frame 10 can be sold only at specialty stores that offer assistance (personnel or special carts) for transporting the conventional bed frame to the check-out counter and to the customer's vehicle.

Figure 11:
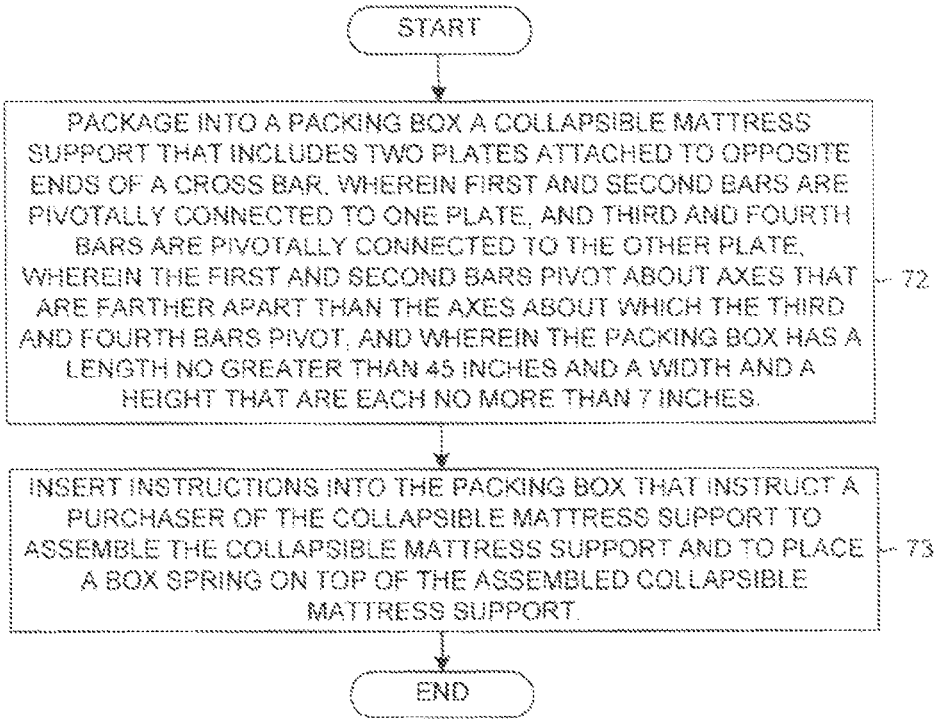
FIG. 11 is a flowchart of steps for packaging the mattress support of FIG. 2 into a packing box.

FIG. 11 is a flowchart of steps 72-73 for packaging collapsible mattress support 20 into a packing box for shipment from the manufacturer to a mass-market retail store. Step 72 describes packaging mattress support 20 into a packing box whose length is no greater than forty-five inches and whose width and height are each no more than 7 inches. Mattress support 20 includes a first plate and a second plate that are attached to opposite ends of a cross bar. First and second bars are pivotally connected to the first plate, and third and fourth bars are pivotally connected to the second plate. The first and second bars pivot about parallel axes that are orthogonal to the first plate, the third and fourth bars pivot about parallel axes that are orthogonal to the second plate. The axes about which the first and second bars pivot are spaced farther apart than the axes about which the third and fourth bars pivot. The packing box has length no greater than forty-five inches and a width and a height that are each no more than seven inches.

Step 73 involves instructing a purchaser of collapsible mattress support 20 to assemble the mattress support and to place a box spring on top of the assembled mattress support. The mattress support is sturdy but yet collapsible into a small size that fits into the aforementioned packing box because the mattress support includes hinges on a middle cross bar that permit four side bars to fold in parallel to the middle cross bar.

Figure 12:
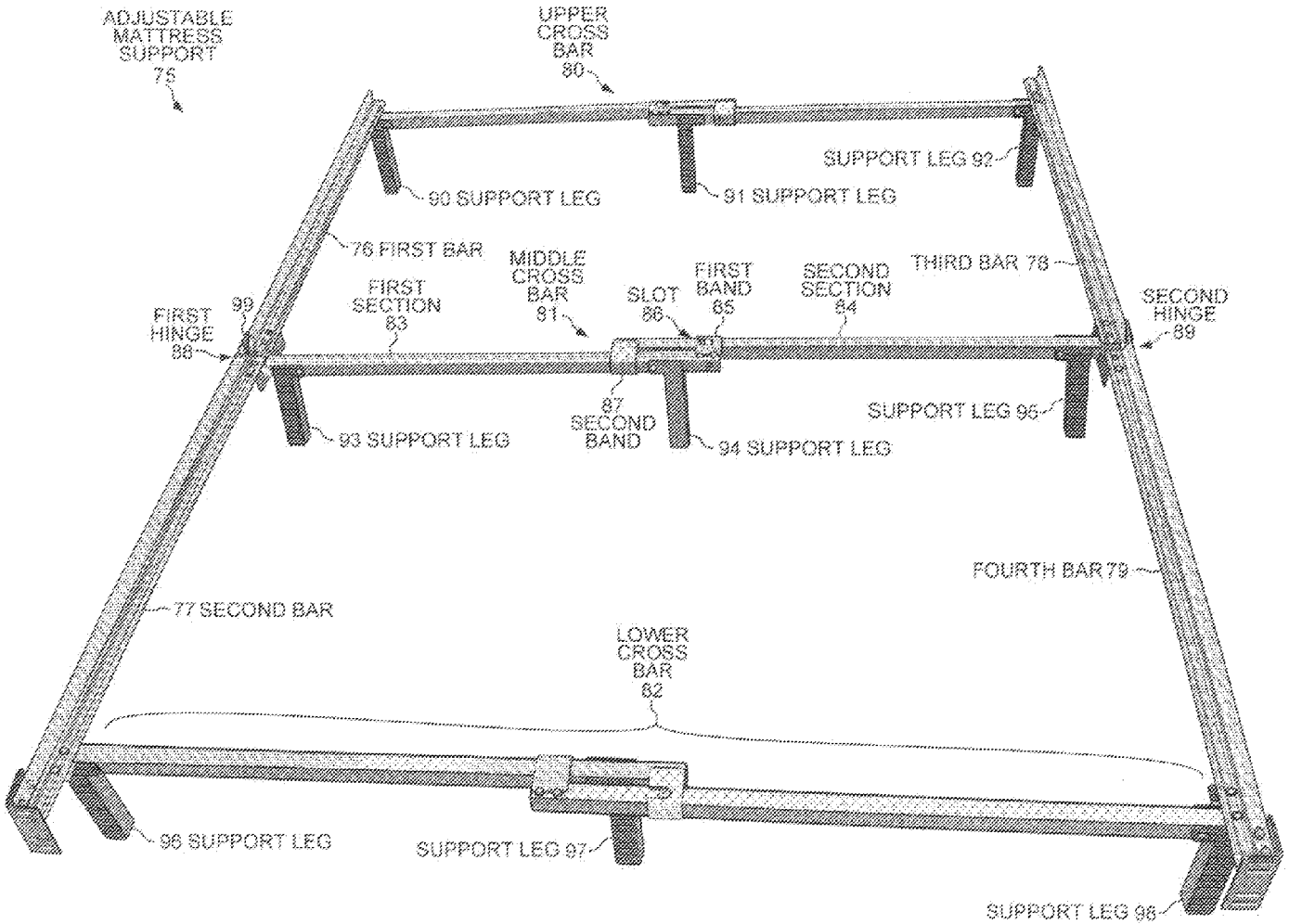
FIG. 12 is a perspective view of an adjustable, collapsible, compact mattress support with folding side bars.

FIG. 12 shows another embodiment of a collapsible, compact mattress support 75 for which the cross bars expand to a predetermined mattress width. Each of the cross bars of mattress support 75 has two sections that slide by each other. Mattress support 75 includes a first bar 76, a second bar 77, a third bar 78, a fourth bar 79, an upper cross bar 80, a middle cross bar 81 and a lower cross bar 82. FIG. 12 shows mattress support 75 in an assembled and fully extended condition. In the assembled condition, each of the cross bars 80-82 is fully extended and parallel to the other cross bars. In addition, each of the bars 76-79 is perpendicular to the cross bars 80-82.

Each cross bar has two sections that slide past each other. For example, middle cross bar 81 has a first section 83 that is slidably connected to a second section 84. First section 83 is fixedly attached to a first band 85 that folds around second section 84 and slides along second section 84. First band 85 includes a slot 86. A bolt passes through second section 84 and is aligned to slide into slot 86 when middle cross bar 81 is fully extended. Second section 84 is fixedly attached to a second band 87 that folds around first section 83 and slides along first section 83. Upper cross bar 80 and lower cross bar 82 are similarly formed by two sections that slide along each other.

First section 83 of middle cross bar 81 is attached to first bar 76 and second bar 77 by a first hinge 88. In addition, second section 84 of middle cross bar 81 is attached to third bar 78 and fourth bar 79 by a second hinge 89. Middle cross bar 81 remains pivotally connected to all of first bar 76, second bar 77, third bar 78 and fourth bar 79 even in the collapsed condition in which mattress support 75 is shipped. However, in the collapsed condition, upper cross bar 80 is separated from first bar 76 and third bar 78, and lower cross bar 82 is separated from second bar 77 and fourth bar 79. Mattress support 75 has nine folding support legs that can pivot from a folded position to an extended position. Three hinged support legs 90-92 are pivotally attached to upper cross bar 80. Hinged support legs 93-95 are pivotally attached to middle cross bar 81. And hinged support legs 96-98 are pivotally attached to lower cross bar 82. In the assembled condition of mattress support 75 shown in FIG. 12, each of support legs 90-98 is in the extended position.

First hinge 88 functions in the same manner as does first hinge 30 of mattress support 20 shown in FIGS. 3-5. First hinge 88 has a plate that is fixedly attached to first section 83. The plate is pivotally attached to both first bar 76 and to second bar 77. First bar 76 pivots about a first axis, and second bar 77 pivots about a second axis. The first axis and the second axis are both orthogonal to the plate and each passes through the plate at a separate fixed location. Four holes pass through the plate. First bar 76 and second bar 77 are pivotally attached to the plate by bolts that pass through the inner two of the four holes; no bolts pass through the outer two of the four holes. A clasp 99 is adapted to lock first bar 76 to second bar 77 such that first bar 76 is oriented parallel to second bar 77 and perpendicular to first section 83 when mattress support 75 is unfolded and in the assembled condition. First bar 76 and second bar 77 are substantially parallel to first section 83 when clasp 99 is unlocked and mattress support 75 is folded.

Figure 13:
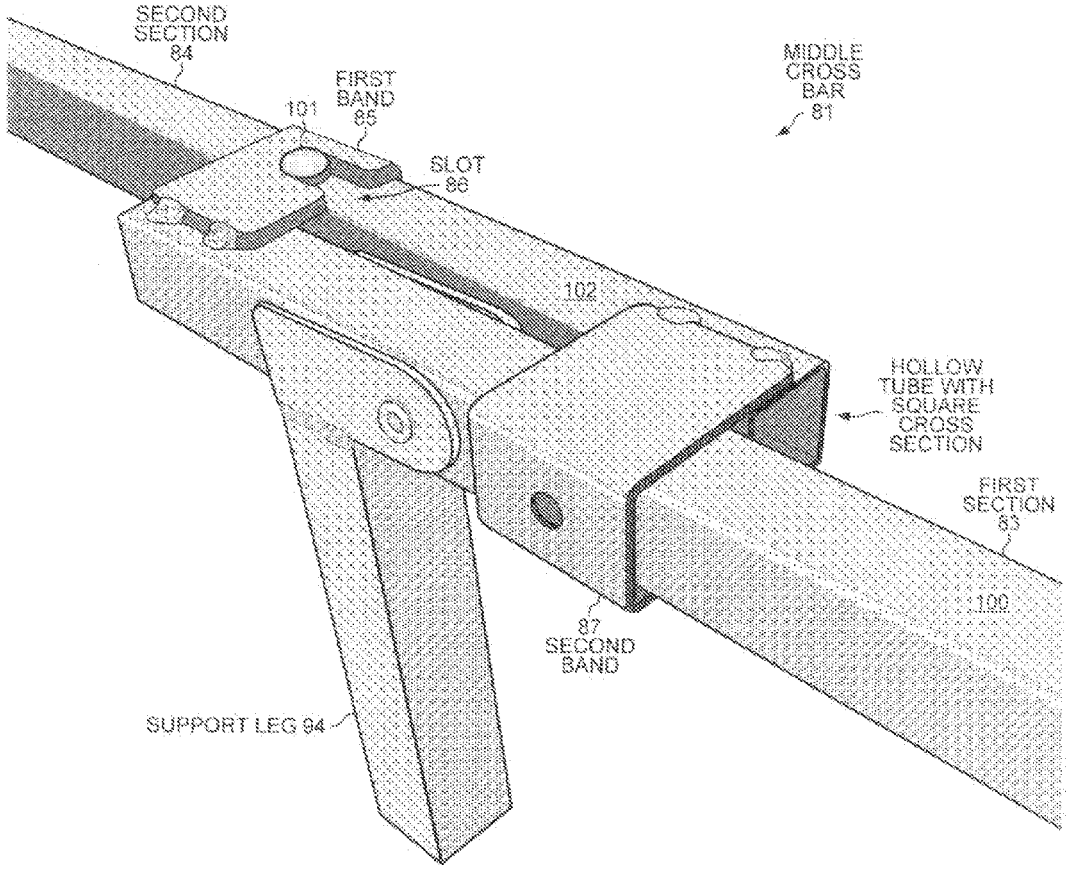
FIG. 13 shows an extendable cross bar of the mattress support of FIG. 12.

FIG. 13 shows the overlapping portion of middle cross bar 81 in more detail. Each of the sections of the cross bars 80-82 is a hollow tube with a square cross section, as is shown in FIG. 13 with regard to second section 84. The square tube form of the cross bars allows the bars to be sufficiently strong despite having a metal thickness of less than one sixteenth of an inch. First section 83 has an upper surface 100 that is coplanar with the plate. First band 85 is fixedly attached to upper surface 100 and to a lower surface of first section 83 and wraps around and slides along second section 84. Slot 86 in first band 85 is aligned to slide around a bolt 101 that passes through second section 84. Bolt 101 prevents second section 84 from sliding past first section 83 beyond a desired total length of middle cross bar 81 that is determined by the position of bolt 101 in second section 84. Second band 87 is fixedly attached to an upper surface 102 and a lower surface of second section 84. Support leg 94 is pivotally attached to first section 83 at a location that remains between first band 85 and second band 87 regardless of whether middle cross bar is extended or collapsed.

Figure 14:
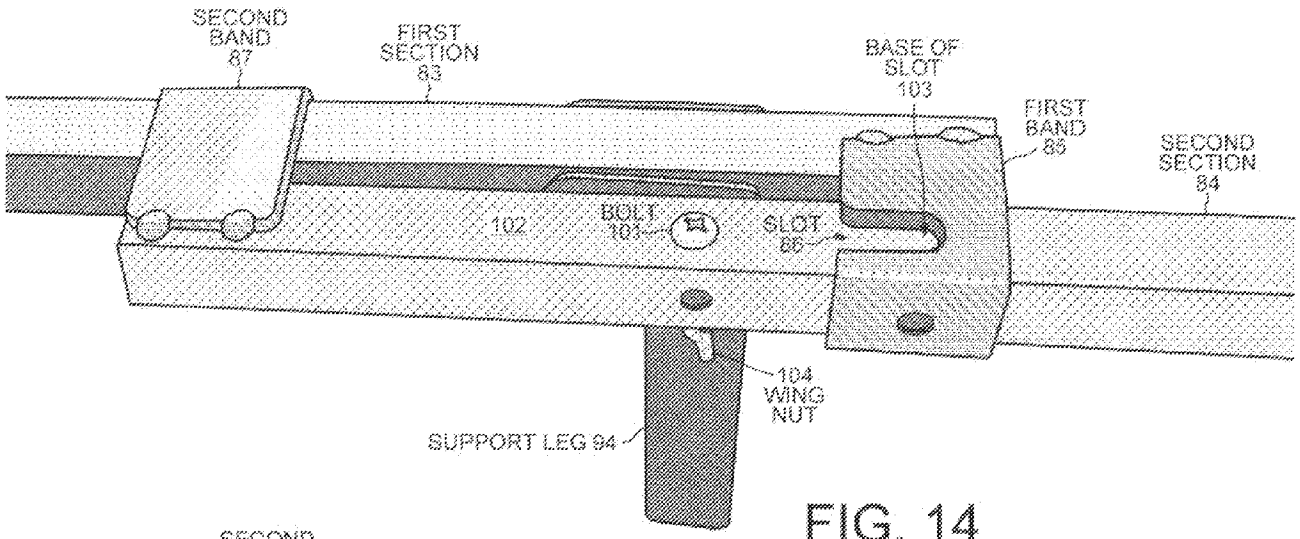
FIG. 14 shows an extendable cross bar that is less than fully extended.

FIG. 14 shows the slidably connected, overlapping portion of middle cross bar 81 from a different angle in a partially collapsed condition. Cross bar 81 is not fully extended in FIG. 14 because bolt 101 has not slid into the base 103 of slot 86. Bolt 101 passes through a hole in upper surface 102 and a second hole in the lower surface of second section 84. The holes are aligned such that the head of bolt 101 slides into slot 86 when middle cross bar 81 is fully extended. The bolt is secured in the holes by a wing nut 104. When the head of bolt 101 fits into the base 103 of slot 86, the base of the slot is aligned over the hole in the upper surface 102. The hole is placed in second section 84 such that the total length of middle cross bar 81 has a desired length when bolt 101 fits into base 103. For example, when bolt 101 is slid into slot 86, cross bar 81 is approximately sixty inches long, which corresponds to the width of a queen size mattress.

Figure 15:
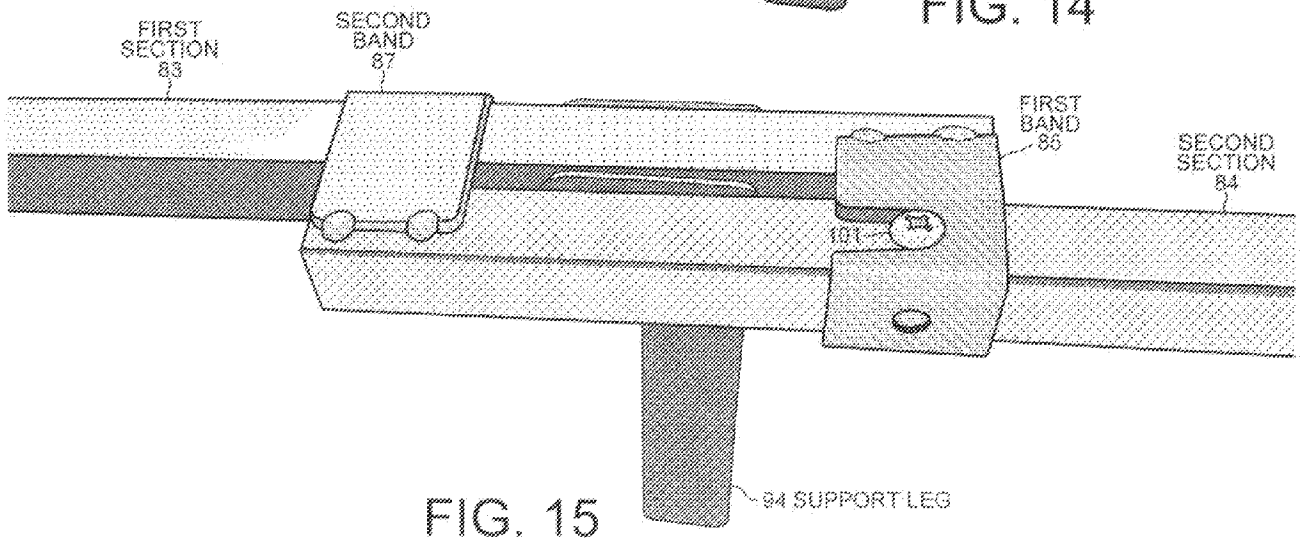
FIG. 15 shows the cross bar of FIG. 14 that has been extended to a predetermined length.

FIG. 15 shows cross bar 81 of FIG. 14 after bolt 101 has been slid into base 103 of slot 86.

Figure 16:
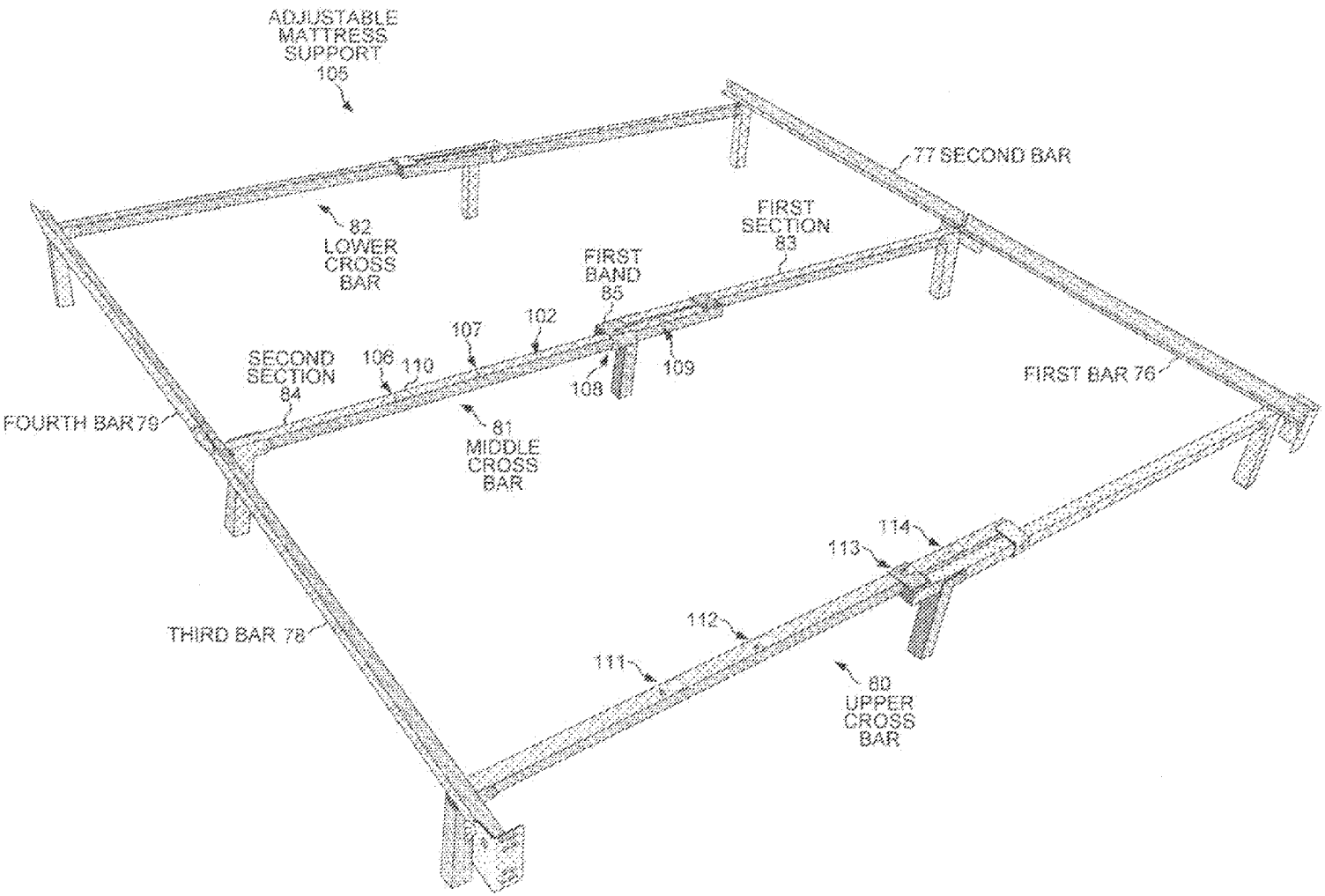
FIG. 16 shows a compact mattress support whose width can be adjusted to accommodate a box spring and mattress of four different widths.

FIG. 16 shows yet another embodiment of a collapsible, compact mattress support 105 that is adjustable to fit box springs and mattresses of different widths. Each of the cross bars of mattress support 105 is extendable and has two sections that slide by each other. Mattress support 105 has the same design as mattress support 75 except that the sections of the cross bars are longer, and four holes pass through both upper surface 102 and the lower surface of second section 84 of middle cross bar 81 and through the corresponding sections of the other cross bars 80 and 82.

Second section 84 has upper surface 102 through which a first hole 106, a second hole 107, a third hole 108 and a fourth hole 109 pass. Base 103 of slot 86 aligns over one of the holes 106-109 depending on how far first section 83 is slid along second section 84. A bolt placed through the hole locks in slot 86 when the sections of the cross bar are pulled away from each other. By sliding first section 83 past second section 84 until base 103 of slot 86 is aligned over one of the holes, the length of middle cross bar 81 can be adjusted to accommodate the widths of various sized mattresses, such as full or double (54-inch width), Queen size (60-inch width), California King size (72-inch width) and Eastern King size (76-inch width). Stickers 110 next to each hole indicate the mattress size that corresponds to the hole. The cross bars in FIG. 16 are adjusted so that slot 86 is aligned over the third hole 108, which results in a 72-inch length of the cross bars. However, the cross bars of mattress support 105 could also be extended as far as seventy-six inches when base 103 of slot 86 aligns over fourth hole 109. The upper and lower cross bars have similar holes that are used to adjust their lengths. For example, upper cross bar 80 has holes 111-114. Note that mattress support 105 has been assembled with lower cross bar 82 having a reverse orientation compared to cross bars 80-81, i.e., the first and second sections 83-84 are in opposite positions. Upper cross bar 80 and lower cross bar 82 can be assembled in either orientation with respect to the side bars 76-79. Middle cross bar 81 is, however, permanently pivotally attached to the side bars 76-79. When mattress support 105 is collapsed, the upper and lower cross bars 80 and 82 are disconnected and compressed, the middle cross bar 81 is compressed, and the side bars 76-79 are folded in parallel to the first and second sections 83-84.

Although certain specific exemplary embodiments are described above in order to illustrate the invention, the invention is not limited to the specific embodiments. Although the mattress support is described above as being constructed of metal, the mattress support may also be made of tubes of plastic. Although the cross bars are described as having a square cross section, the mattress support can also be made of bars having round cross sections. Accordingly, various modifications, adaptations, and combinations of various features of the described embodiments can be practiced without departing from the scope of the invention as set forth in the claims.

What is claimed is:

1. A foldable mattress support comprising:

a cross bar with a first section and a second section, wherein the first section is slidably connected to the second section, wherein the first section is fixedly attached to a first band that folds around the second section and slides along the second section, wherein the first band includes a slot, and wherein a bolt passes through the second section and is aligned to slide into the slot;

a first plate fixedly attached to the first section;

a first bar pivotally attached to the first plate, wherein the first bar pivots about a first axis; and a second bar pivotally attached to the first plate, wherein the second bar pivots about a second axis, and wherein each of the first axis and the second axis is orthogonal to the first plate and passes through the first plate at a separate fixed location.

2. The foldable mattress support of claim 1, wherein the first section has an upper surface, and wherein the first plate has a top that is coplanar with the upper surface.

3. The foldable mattress support of claim 2, wherein the first section is a hollow tube with a square cross section, and wherein the first band is fixedly attached to the upper surface and to a lower surface of the first section.

4. The foldable mattress support of claim 1, wherein the cross bar is approximately sixty inches long when the bolt is slid into the slot.

5. The foldable mattress support of claim 1, wherein the first section is a hollow tube of metal, wherein the hollow tube has a square cross section, and wherein the metal of the hollow tube has a thickness of less than one sixteenth of an inch.

6. The foldable mattress support of claim 1, further comprising:

a clasp adapted to lock the first bar to the second bar such that the first bar is oriented parallel to the second bar and perpendicular to the cross bar.

7. The foldable mattress support of claim 1, wherein the second section is fixedly attached to a second band that folds around the first section and slides along the first section, further comprising:

a leg pivotally attached to the first section at a location that remains between the first band and the second band.

8. The foldable mattress support of claim 1, further comprising:

a second plate fixedly attached to the second section;

a third bar pivotally attached to the second plate, wherein the third bar pivots about a third axis; and a fourth bar pivotally attached to the second plate, wherein the fourth bar pivots about a fourth axis, and wherein each of the third axis and the fourth axis is orthogonal to the second plate and passes through the second plate at a separate fixed location.

9. The foldable mattress support of claim 1, wherein four holes pass through the first plate, wherein the first bar and the second bar are pivotally attached to the first plate by bolts that pass through the inner two of the four holes, and wherein no bolts pass through the outer two of the four holes.

10. The foldable mattress support of claim 1, wherein the first bar and the second bar are substantially parallel to the first section when the clasp is unlocked and the foldable mattress support is folded.

11. A foldable mattress support comprising:

a cross bar with a first section and a second section, wherein the first section is slidably connected to the second section, wherein the first section is fixedly attached to a first band that wraps around the second section and slides along the second section, wherein the first band includes a slot, and wherein the slot is aligned to slide around a bolt that passes through the second section;

a first plate attached to the first section;

a second plate attached to the second section, wherein the first plate and the second plate are coplanar;

a first bar pivotally attached to the first plate, wherein the first bar pivots about a first axis;

a second bar pivotally attached to the first plate, wherein the second bar pivots about a second axis;

a third bar pivotally attached to the second plate, wherein the third bar pivots about a third axis; and a fourth bar pivotally attached to the second plate, wherein the fourth bar pivots about a fourth axis, wherein each of the first axis, the second axis, the third axis and the fourth axis is orthogonal to the first plate, and wherein the first bar, the second bar, the third bar and the fourth bar are all substantially parallel to one another when the foldable mattress support is folded.

12. The foldable mattress support of claim 11, wherein four holes pass through the first plate, wherein the first bar and the second bar are pivotally attached to the first plate by bolts that pass through the outer two of the four holes, and wherein no bolts pass through the inner two of the four holes.

13. The foldable mattress support of claim 11, wherein the first band is fixedly attached to an upper surface and to a lower surface of the first section.

14. The foldable mattress support of claim 11, further comprising:

a clasp adapted to lock the first bar to the second bar such that the first bar is oriented parallel to the second bar and perpendicular to the cross bar.

15. The foldable mattress support of claim 11, wherein four holes pass through the first plate, and wherein the first axis and the second axis pass through the outer two of the four holes.

16. A foldable mattress support comprising:

a cross bar with a first section and a second section, wherein the first section is slidably connected to the second section, wherein the first section is fixedly attached to a first band that wraps around the second section and slides along the second section, wherein the second section has a surface through which a first hole and a second hole pass, wherein the first band includes a slot with a base, and wherein the base of the slot aligns over the first hole or the second hole depending on how far the first section is slid along the second section;

a plate fixedly attached to the second section;

a first bar pivotally attached to the plate, wherein the first bar pivots about a first axis; and a second bar pivotally attached to the plate, wherein the second bar pivots about a second axis, and wherein each of the first axis and the second axis is orthogonal to the plate and passes through the plate at a separate fixed location.

17. The foldable mattress support of claim 16, wherein the plate has a top that is coplanar with the surface.

18. The foldable mattress support of claim 16, wherein the second section is a hollow tube with a square cross section, wherein a third hole passes through a bottom surface of the second section directly below the first hole, and wherein a bolt passes through the first hole and the third hole and the base of the slot.

19. The foldable mattress support of claim 16, wherein four holes pass through the plate, wherein the first bar and the second bar are pivotally attached to the plate by bolts that pass through the inner two of the four holes, and wherein no bolts pass through the outer two of the four holes.

20. The foldable mattress support of claim 16, wherein the cross bar is approximately sixty inches long when the base of the slot aligns over the first hole, and wherein the cross bar is approximately seventy-six inches long when the base of the slot aligns over the second hole.

* * * * *